United States Patent [19]

Kobayashi et al.

[11] Patent Number: 4,692,663

[45] Date of Patent: Sep. 8, 1987

[54] FLUORESCENT DISPLAY TUBE FOR LIGHT SOURCE

[75] Inventors: Masaaki Kobayashi; Yosiyuki Okubo; Kazunori Tatsuda, all of Ise, Japan

[73] Assignee: Ise Electronics Corporation, Ise, Japan

[21] Appl. No.: 880,139

[22] Filed: Jun. 30, 1986

[30] Foreign Application Priority Data

Jul. 8, 1985 [JP] Japan ..... 60-148215

[51] Int. Cl.[4] ..... H01J 63/06

[52] U.S. Cl. ..... 313/495

[58] Field of Search ..... 313/495, 496, 497, 422

[56] References Cited

U.S. PATENT DOCUMENTS 2,956,194 10/1960 Alma et al. ..... 313/495
4,156,239 5/1979 Hirano et al. ..... 313/496 X
4,341,980 7/1982 Noguchi et al. ..... 313/495 X
4,633,134 12/1986 Kishino et al. ..... 313/497

FOREIGN PATENT DOCUMENTS 0095261 7/1980 Japan ..... 313/495

*Primary Examiner*—Palmer C. DeMeo
*Attorney, Agent, or Firm*—Maurice E. Gauthier

[57] ABSTRACT

A fluorescent display tube includes a plurality of phosphor screens formed on a front panel of an envelope to constitute a matrix, a plurality of cathode electrodes floating from the inner surface of a rear panel of the envelope and corresponding to the phosphor screens so as to constitute a matrix in the same manner as the phosphor screens, grid electrodes which are arranged between the phosphor screens and the cathode electrodes of the rows of the matrix and each of which has electron beam apertures, and stripe-like back electrodes formed on the inner surface of the rear panel so as to correspond to the columns of the matrix. A voltage applied to the cathode electrodes is higher or lower than that to the grid and back electrodes. Light emission of the phosphor screens can be arbitrarily controlled to obtain high resolution with a compact arrangement.

4 Claims, 4 Drawing Figures

FLUORESCENT DISPLAY TUBE FOR LIGHT SOURCE

BACKGROUND OF THE INVENTION

The present invention relates to a display tube or cathode-ray tube and, more particularly, to a fluorescent display tube constituting a pixel of a color display device.

A large-screen color display device having a large number of fluorescent display tubes of different colors has been used in a variety of practical applications.

FIG. 1 shows a screen surface of a conventional color display device of this type. The circles represent display surfaces of single-color fluorescent display tubes. Reference symbols R, G, and B denote red, green, and blue, respectively. Three each of red, green, and blue fluorescent display tubes, a total of nine tubes, are used to constitute a 3 (rows)×3 (columns) matrix. A conventional color display device of this matrix arrangement has a low total resolution due to predetermined spaces between adjacent tubes. In addition, the numbers of parts and manufacturing steps are large, resulting in inconvenience.

SUMMARY OF THE INVENTION

It is an object of the present invention to provide a fluorescent display tube for a light source wherein the conventional problems can be solved, the resolution of a large-screen color display can be increased, and the manufacturing cost can be reduced.

In order to achieve the above object of the present invention, there is provided a fluorescent display tube comprising: an envelope constituted by a front panel, a rear panel, and a side panel, at least the front panel being able to transmit light therethrough; a plurality of phosphor screens formed on an inner surface of the front panel to constitute a matrix in a first direction and in a second direction perpendicular to the first direction; a plurality of anodes, respectively arranged around the phosphor screens, for accelerating electron beams; a plurality of cathodes, respectively corresponding to the phosphor screens and supported to float from an inner surface of the rear panel, for emitting the electron beams; plate-like control grids which are respectively arranged between the phosphor screens and the cathodes arranged in the first direction, and which have apertures for transmitting the electron beams from the cathodes to the phosphor screens; and stripe-like back electrodes which oppose the cathodes aligned on the inner surface of the rear panel along the second direction, wherein voltages applied to the control and back electrodes are higher or lower than those applied to the cathodes, thereby controlling light emission of the phosphor screens.

DETAILED DESCRIPTION OF THE PREFERRED EMBODIMENT

The present invention will be described in detail with reference to the accompanying drawings.

Figure 1:
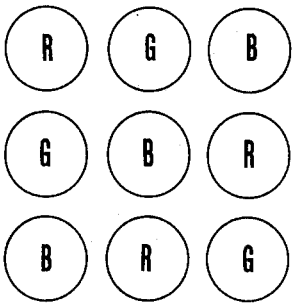
FIG.1 (PRIOR ART)
FIG. 1 is a schematic view for explaining a color display device using conventional fluorescent display tubes for a light source.
Figure 2:
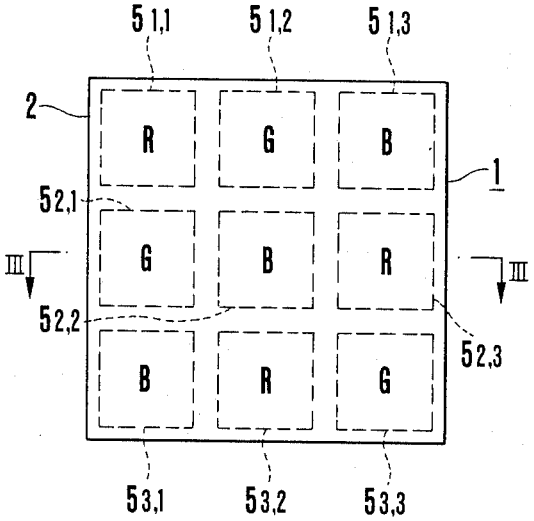
FIG. 2 is a front view of a fluorescent display tube for a light source according to an embodiment of the present invention.
Figure 3:
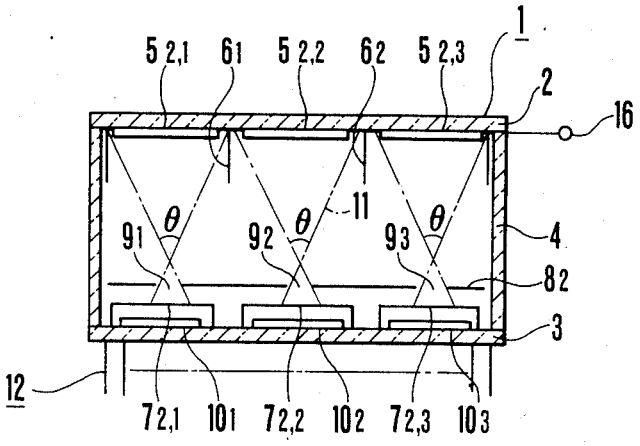
FIG. 3 is a sectional view of the display tube in FIG. 2 taken along the line III—III thereof.
Figure 4:
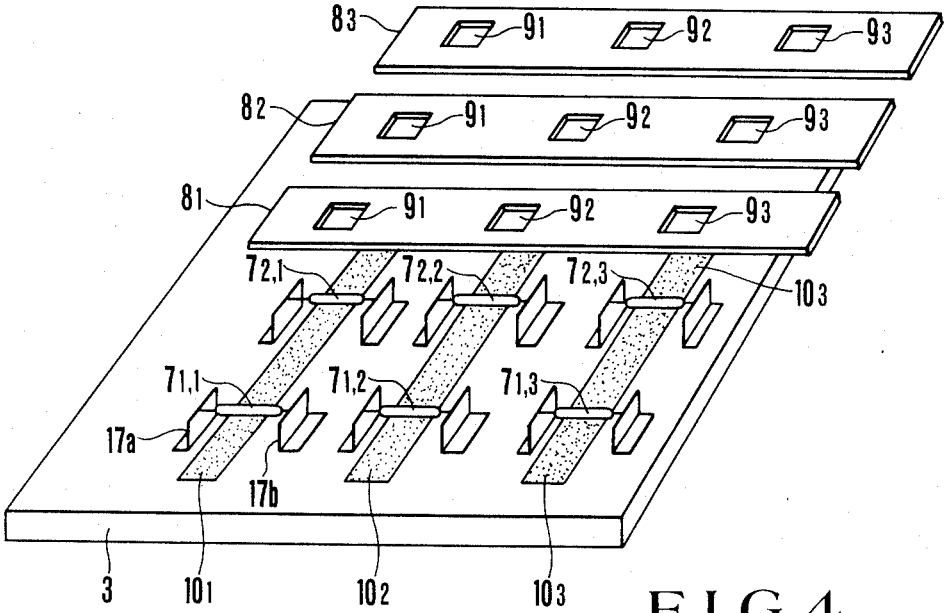
FIG. 4 is a perspective view showing part of the display tube in FIGS. 2 and 3.

FIG. 2 represents an illustration of a front display screen of a fluorescent display tube for a light source according to an embodiment of the present invention; FIG. 3 is a sectional view thereof taken along the line III—III thereof; and FIG. 4 is a perspective view showing part thereof. Referring to FIGS. 2 to 4, an envelope 1 is constituted by a glass front panel 2, a glass rear panel 3, and a glass side panel 4, which form a box-like shape. The envelope 1 is kept in vacuum. Phosphor screens $\mathbf{5}_{1,1}$, $\mathbf{5}_{1,2}$, . . . $\mathbf{5}_{3,3}$ of red, green, and blue phosphors are formed on the inner surface of the front panel 2 to constitute a matrix, as shown in FIG. 2. The phosphor screens are close to each other. Reference letters R, G, and B in FIG. 2 represent red, green, and blue, respectively. A plurality of accelerating anodes $\mathbf{6}_1$, $\mathbf{6}_2$, . . . are arranged corresponding to the boundaries between adjacent ones of phosphor screens $\mathbf{5}_{1,1}$ to $\mathbf{5}_{3,3}$. The anodes $\mathbf{6}_1$, $\mathbf{6}_2$, . . . are applied with a high voltage through an external terminal 16. Electron-emitting cathodes $7_{1,1}$ to $7_{3,3}$, respectively corresponding to the phosphor screens $\mathbf{5}_{1,1}$ to $\mathbf{5}_{3,3}$, are arranged in a matrix form in the same manner as the phosphor screens. Each of the cathodes $7_{1,1}$ to $7_{3,3}$ is supported between a pair of supports 17*a* and 17*b* fixed on the rear panel 3. An indirect heating type cathode prepared by coating an oxide on an Ni sleeve, or a direct heating type cathode prepared by coating an oxide on tungsten or the like can be used as each of the cathodes $7_{1,1}$ to $7_{3,3}$.

Discrete row selection control grids $\mathbf{8}_1$ to $\mathbf{8}_3$ are arranged between the cathode electrodes and the phosphor screens of the respective matrix rows. Each of the control grids $\mathbf{8}_1$ to $\mathbf{8}_3$ has electron beam apertures $\mathbf{9}_1$ to $\mathbf{9}_3$ for transmitting electron beams 11 as nonfocused beams from corresponding ones of the cathodes $7_{1,1}$ to $7_{3,3}$ to the corresponding phosphor screens $\mathbf{5}_{1,1}$ to $\mathbf{5}_{3,3}$.

Stripe-like three column selection back electrodes $\mathbf{10}_1$ to $\mathbf{10}_3$ are formed on the inner surface of the rear panel 3 so as to correspond to the columns of the matrix constituted by the cathodes $7_{1,1}$ to $7_{3,3}$. The back electrodes $\mathbf{10}_1$ to $\mathbf{10}_3$ are formed by conductive layers of Ag or the like. A negative and 0 V or a positive voltage of several volts, with respect to the potential at the cathodes $7_{1,1}$ to $7_{3,3}$, are applied to the back electrodes $\mathbf{10}_1$ to $\mathbf{10}_3$ to control the electron beams 11 emitted from the cathodes $7_{1,1}$ to $7_{3,3}$. Reference numeral 12 in FIG. 3 denotes lead pins as external terminals for leading the cathode, grid and back electrodes $7_{1,1}$ to $7_{3,3}$, $\mathbf{8}_1$ to $\mathbf{8}_3$, and $\mathbf{10}_1$ to $\mathbf{10}_3$ outside, through the back panel 3.

The basic operation of the arrangement described above will now be described. Assume that the back electrode $\mathbf{10}_1$ is kept negative with respect to the potential at the cathodes $7_{1,1}$, $7_{2,1}$, and $7_{3,1}$. In this case, the electrons from the cathodes $7_{1,1}$, $7_{2,1}$, and $7_{3,1}$ corresponding to the back electrode $\mathbf{10}_1$ are not supplied to the control grids $\mathbf{8}_1$ to $\mathbf{8}_3$ and the anode $\mathbf{6}_1$, and the cutoff state is obtained. If 0 V or a positive voltage of several volts, with respect to the potential at the cathodes $7_{1,1}$ to $7_{3,3}$, is applied to the back electrode $\mathbf{10}_1$, the electron beams 11 from the cathodes $7_{1,1}$, $7_{2,1}$, and $7_{3,1}$ are supplied toward the control grids $\mathbf{8}_1$ to $\mathbf{8}_3$. For example, if the control grid $\mathbf{8}_1$ is negative with respect to the cathodes $7_{1,1}$ to $7_{3,3}$, the electron beam 11 cannot pass through the aperture $\mathbf{9}_1$ or reach the corresponding anode $6_1$, and the phosphor screen $5_{1,1}$ cannot emit light. However, if the control grid $8_1$ is positive with respect to the cathodes $7_{1,1}$ to $7_{3,3}$, the electron beam 11 can pass through the corresponding aperture $9_1$ to emit light from the phosphor screen $5_{1,1}$. The above operation can also be applied to the back electrodes $10_2$ and $10_3$ and the control grids $8_2$ and $8_3$. By selectively driving the control grids $8_1$ to $8_3$ and the back electrodes $10_1$ to $10_3$, i.e., by performing dynamic driving thereof, the phosphor screens $5_{1,1}$ to $5_{3,3}$ at the intersections of the control grids and the back electrodes can be arbitrarily driven.

In the above embodiment, the number of phosphor screens is $3\times3$. However, the total number is not limited to 9. In addition, the number of phosphor colors need not be limited to three.

According to the present invention as described above, a composite fluorescent display tube for a light source incorporating a plurality of pixels in a single vacuum envelope can have a higher resolution since the space between adjacent pixels can be reduced. In addition, the numbers of parts and manufacturing steps can be reduced. At the same time, the structure of the display tube can be simplified. The display tube can be effectively applied to a large-screen display device, providing many practical advantages.

What is claimed is:

1. A fluorescent display tube comprising:

an envelope constituted by a front panel, a rear panel, and a side panel, at least said front panel being able to transmit light therethrough;

a plurality of phosphor screens formed on an inner surface of said front panel to constitute a matrix in a first direction and in a second direction perpendicular to the first direction;

a plurality of anodes, respectively arranged around said phosphor screens, for accelerating electron beams;

a plurality of cathodes, respectively corresponding to said phosphor screens and supported to float from an inner surface of said rear panel, for emitting the electron beams;

plate-like control grids which are respectively arranged between said phosphor screens and said cathodes arranged in the first direction, and which have apertures for transmitting the electron beams from said cathodes to said phosphor screens; and stripe-like back electrodes which oppose said cathodes aligned on said inner surface of said rear panel along the second direction, wherein voltages applied to said control and back electrodes are higher or lower than those applied to said cathodes, thereby controlling light emission of said phosphor screens.

2. A tube according to claim 1, wherein said phosphor screens have a square shape and are arranged close to each other.

3. A tube according to claim 1, wherein said phosphor screens are constituted by red, green, and blue phosphor screens, which are provided in the same number.

4. A tube according to claim 1, wherein each of said cathodes is suspended to override a corresponding one of said stripe-like back electrodes through two support members fixed on said inner surface of said rear panel.

* * * * *